US006652303B2

(12) United States Patent
Stockel et al.

(10) Patent No.: US 6,652,303 B2
(45) Date of Patent: Nov. 25, 2003

(54) DEVICE AND METHOD FOR STRENGTHENING AN ELECTRICAL SOCKET

(75) Inventors: Michael J. Stockel, Fort Wayne, IN (US); Gregg E. Laukhuf, Bryan, OH (US)

(73) Assignee: Dekko Engineering, Inc., Butler, IN (US)

( * ) Notice: Subject to any disclaimer, the term of this patent is extended or adjusted under 35 U.S.C. 154(b) by 0 days.

(21) Appl. No.: 10/119,729

(22) Filed: Apr. 10, 2002

(65) Prior Publication Data

US 2003/0194895 A1 Oct. 16, 2003

(51) Int. Cl.[7] ..... H01R 4/60

(52) U.S. Cl. ..... 439/215; 439/107

(58) Field of Search ..... 439/210, 211, 439/214, 215, 217, 107

(56) References Cited

U.S. PATENT DOCUMENTS

| | | | | |
|---|---|---|---|---|
| 2,738,473 | A | 3/1956 | Johnson | 439/215 |
| 4,313,646 | A | 2/1982 | Millhimes et al. | 439/654 |
| 5,092,787 | A | 3/1992 | Wise et al. | 439/215 |
| 5,096,431 | A | 3/1992 | Byrne | 439/171 |
| 5,137,474 | A | 8/1992 | Lin | 439/650 |
| 5,203,712 | A | 4/1993 | Kilpatrick et al. | 439/215 |
| 5,503,565 | A | 4/1996 | McCoy | 439/171 |
| 5,584,714 | A | 12/1996 | Karst et al. | 439/215 |

*Primary Examiner*—Tulsidas Patel
(74) *Attorney, Agent, or Firm*—Taylor & Aust, P.C.

(57) ABSTRACT

An electrical receptacle including at least one conductor member having at least one folded segment oriented to define a receiving socket and a housing having at least one lateral support feature, the at least one folded segment insertable into a corresponding one of the at least one lateral support features along an insertion axis, the at least one lateral support feature supporting the at least one folded segment in a direction transverse to the insertion axis, the housing including at least one blade opening, the at least one blade opening being disposed proximate to at least one of the receiving sockets.

17 Claims, 4 Drawing Sheets

DEVICE AND METHOD FOR STRENGTHENING AN ELECTRICAL SOCKET

BACKGROUND OF THE INVENTION

1. Field of the Invention

The present invention relates to an electrical outlet receptacle, and, more particularly, to a modular electrical outlet receptacle.

2. Description of the Related Art

An office environment, as well as other work locations, often has several types of electrical and electronic equipment, such as computers, printers, photocopiers, communication equipment, facsimile machines, answering machines, etc. Each of these devices must be plugged into a circuit, which provides power from a power distribution system. Office environments often consist of large open areas of floor space, which are divided into separate and distinct areas by way of a wall panel system. The wall panel system can be modular and moved about with relative ease to change an office floor plan.

Modular electrical outlet receptacles may be included in the wall panel system, and provide flexibility in terms of system layout and inter-connectability with other components of the system. Typically a modular electrical receptacle includes at least one connector, which is adapted to interface with a corresponding connector on a wiring harness. The wiring harness typically includes a further connector at an opposing end thereof, which extends to another component of the system, such as another electrical receptacle. A problem with some modular electrical receptacles is the high cost involved to construct the receptacles. Conductors that traverse modular electrical receptacles must be strong enough to withstand repeated insertions and removals of electrical plugs.

Conductors may be formed by folding stamped metal, which serve to conduct power from an external source to a plug inserted into a portion of the formed conductor. Such conductors include a portion of folded metal forming a receiving slot for the insertion of a blade of the plug. Repeated insertions and removals of the blade of the plug may cause the receiving slot to deform.

What is needed in the art is a modular electrical receptacle with metal stamped and bent electrical conductors, which can retain their conductivity through, repeated insertions and retractions of electrical plugs.

SUMMARY OF THE INVENTION

The present invention provides a modular electrical receptacle including a housing, at least one plug-in connector and a face plate having at least two blade openings and an associated ground plug opening.

The invention comprises, in one form thereof, an electrical receptacle including at least one conductor member having at least one folded segment oriented to define a receiving socket and a housing having at least one lateral support feature, the at least one folded segment insertable into a corresponding one of the at least one lateral support features along an insertion axis, the at least one lateral support feature supporting the at least one folded segment in a direction transverse to the insertion axis, the housing including at least one blade opening, the at least one blade opening being disposed proximate to at least one of the receiving sockets.

An advantage of the present invention is that a modular electrical receptacle is provided with a conductor that is less expensive to form.

Another advantage is that the electrical conductor can be constructed from thinner material than would normally be used.

Yet another advantage is that the electrical conductor does not require added clips or springs to prevent deformation of the electrical contacts.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
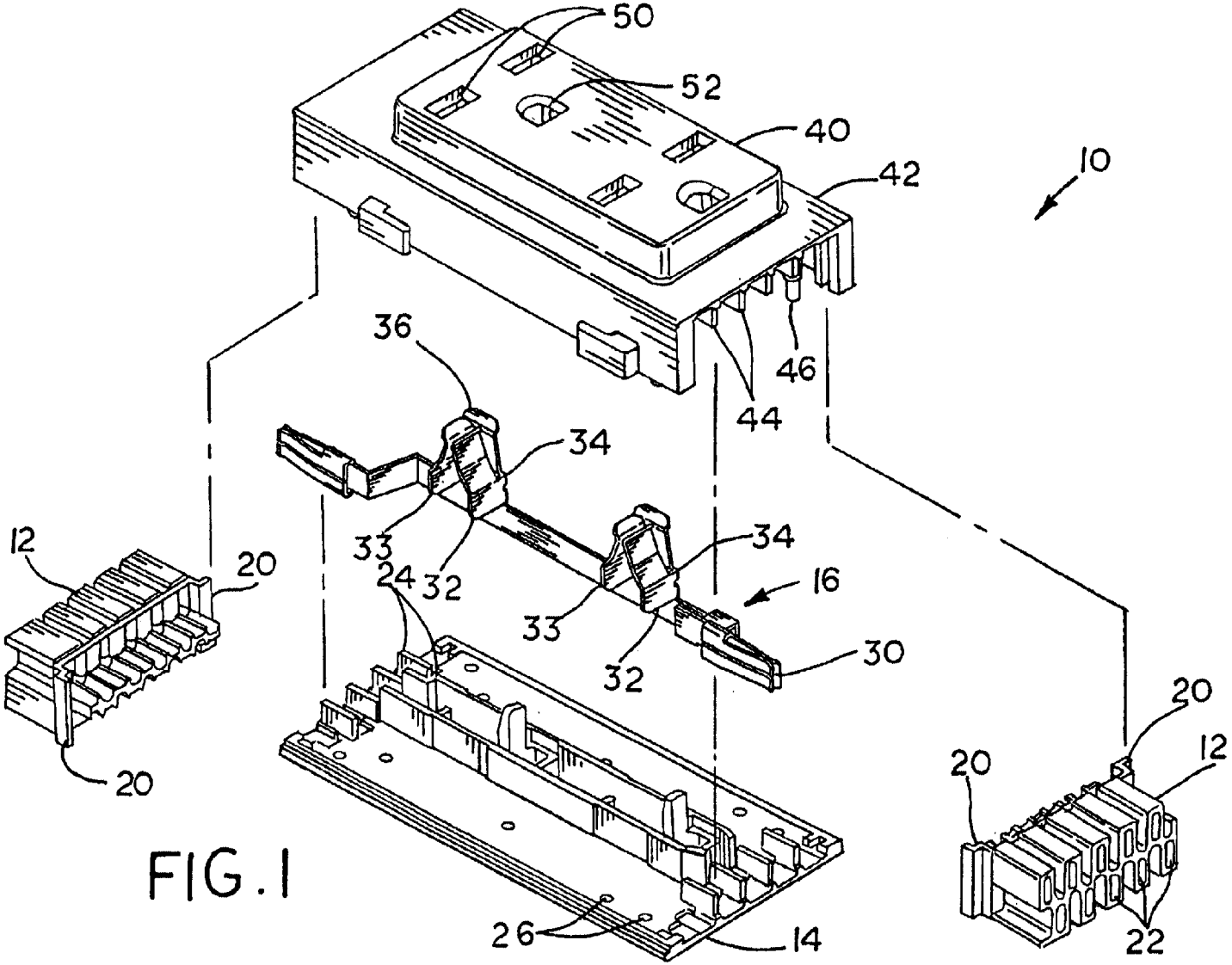
FIG. 1 is perspective exploded view of an embodiment of a modular electrical receptacle of the present invention.

Referring now to the drawings, an embodiment of a modular electrical receptacle 10 of the present invention is shown. Modular electrical receptacle 10 includes electrical connectors 12, a back plate 14, conductor members 16 and a housing 18.

Electrical connectors 12 include connection members 20 and electrical contact receiving openings 22. Connection members 20 are oriented and shaped to be retained by housing 18 as a part of modular electrical receptacle 10. Electrical contact receiving openings 22 are provided to allow interconnection of modular electrical receptacle 10 with other modular electrical receptacles or wiring harnesses. The connection of modular electrical receptacle 10 to a wiring harness or to another modular electrical receptacle 10 provides power through and to modular electrical receptacle 10. Back plate 14 includes protrusions 24 and holes 26. Protrusions 24 are provided to co-act with similar provisions in housing 18 to provide separation of electrical conductors therein. Holes 26 are provided to allow connection of housing 18 to back plate 14 and thereby form an integral unit.

Conductor members 16 include electrical contacts 30, folded segments 32 and 33, folds 34 and receiving socket 36. Conductor members 16 can be variously configured to provide electrical connections from one receiving opening 22 in one electrical connector 12 to another receiving opening 22 in another electrical connector 12. Electrical contacts 30 provide for electrical interconnection between conductor members 16 and other conductor members or wiring harnesses, which are not shown. Electrical contacts 30 extend into electrical contact receiving openings 22 and are separated thereby. Folded segments 32 and 33 are each folded along a fold 34 to economically provide a receiving socket 36 between folded segments 32 and 33. Folded segments 32 and 33 are folded along separate folds 34, which are generally parallel with each other. Folded segments 32 and 33, along with the portion of conductor member 16 between folds 34, have a U-shaped cross-section. Receiving socket 36 is oriented and shaped to accommodate insertion of an electrical prong of an electrical plug, which is not shown. Alternatively, some conductor members 16 may connect power from one electrical connector 12 to another electrical connector 12 and not have a receiving socket 36.

Housing 18 includes a faceplate 40, a housing body 42, contact separators 44, assembly protrusions 46 and channel protrusions 48. Faceplate 40 may be formed integral with housing body 42 thereby forming a single unitary construction. Faceplate 40 includes blade openings 50 and ground openings 52. Blade openings 50 accommodate electrical prongs of a plug not shown. Ground opening 52 is shaped and oriented relative to blade openings 50 to accommodate a ground prong of a grounded plug.

Housing body 42 can be separate from faceplate 40 or alternatively be part of an integral monolithic construction with faceplate 40. Contact separators 44 in housing body 42 separate conductor members 16 from each other. Assembly protrusions 46 in housing 18 accommodate the assembly of back plate 14 to housing 18. Assembly protrusions 46 may either be inserted into holes 26 and extend there beyond for a terminating process or have a blind hole in assembly protrusion 46 to accommodate fasteners inserted through holes 26.

Figure 2:
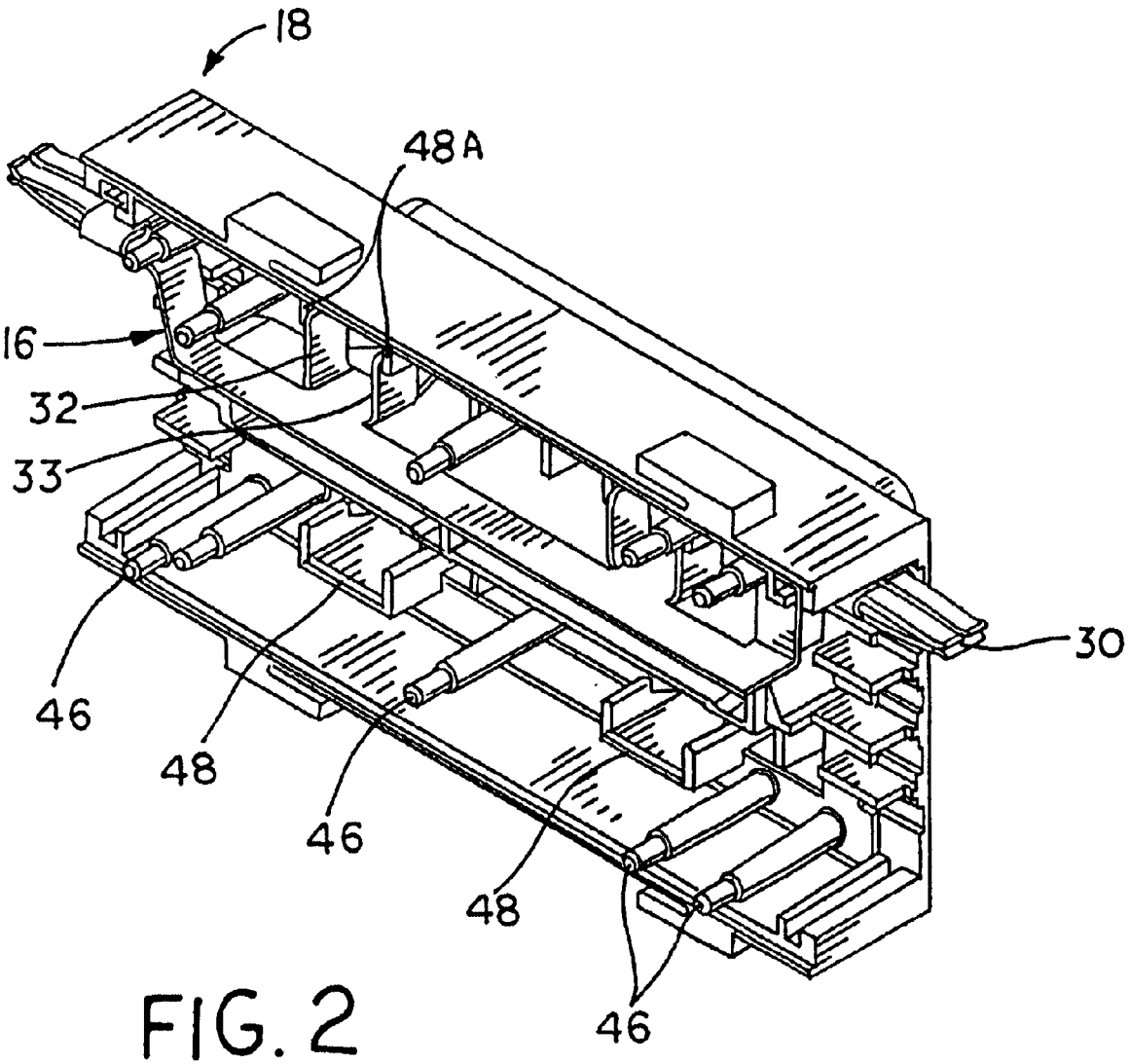
FIG. 2 is another perspective view of the modular electrical receptacle of FIG. 1.
Figure 3:
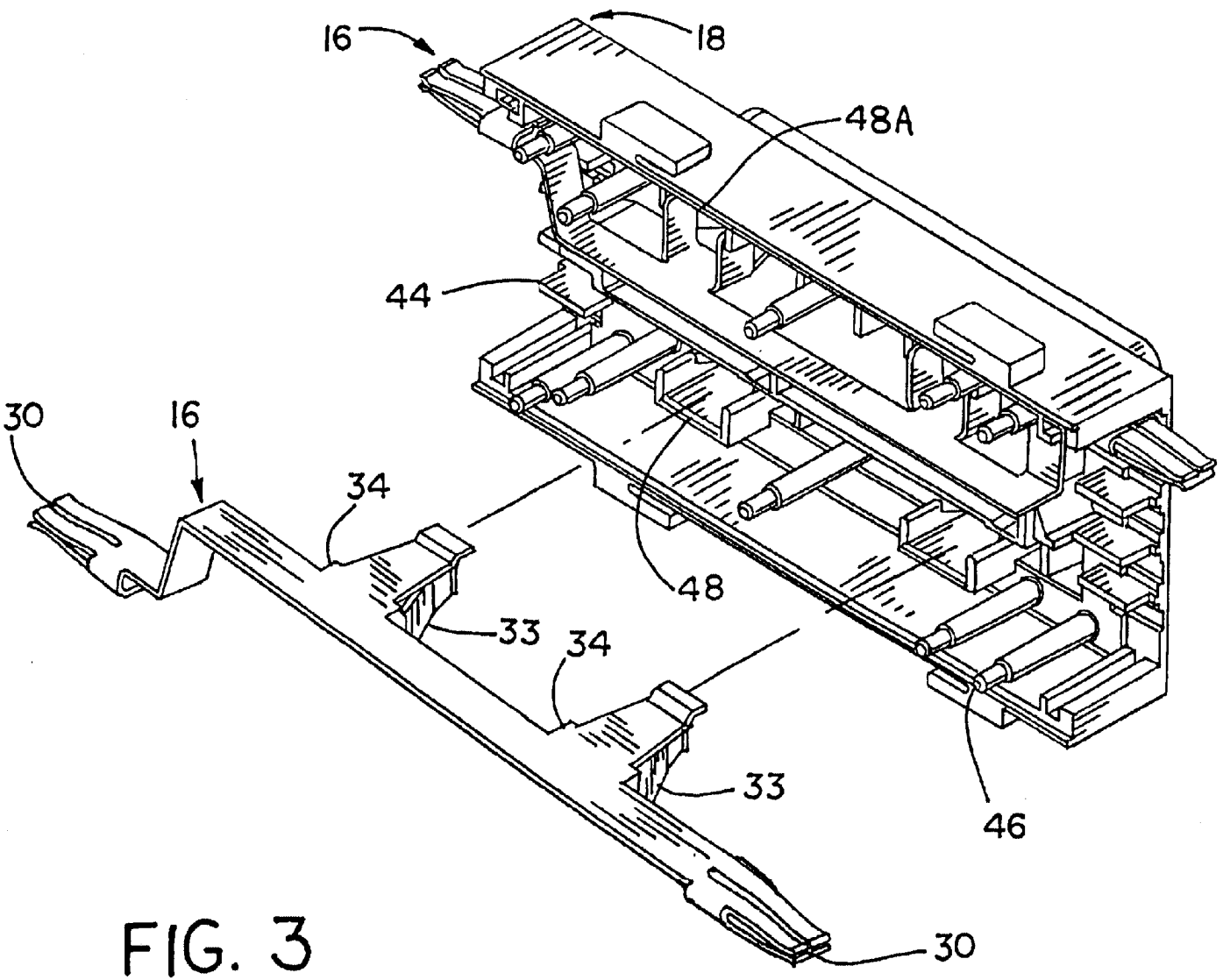
FIG. 3 is another exploded perspective view of the modular electrical receptacle of FIGS. 1 and 2.
Figure 4:
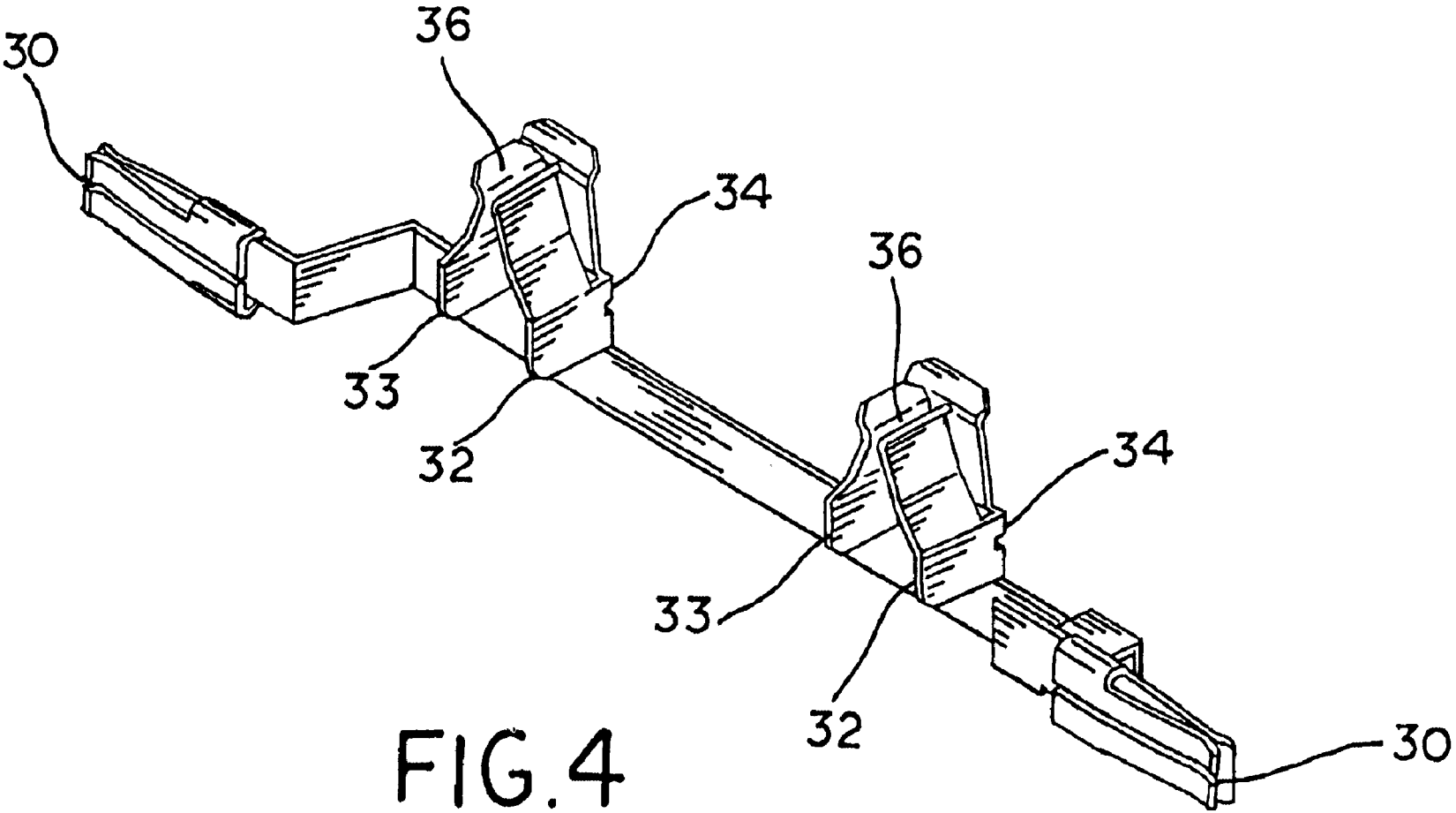
FIG. 4 is a perspective view of an electrically conductive component of the modular electrical receptacle of FIGS. 1–3.

Channel protrusion 48 is a generally U-shaped protrusion in housing 18 that accommodates folded segments 32 and 33 of conductor member 16. Alternatively, one or more of the sides of channel protrusion 48 may be common with a surface of housing 18, as illustrated by channel protrusion 48A or channel protrusion 48 may take the form of a recess in housing 18. Folded segments 32 and 33 are inserted into channel protrusion 48 such that the U-shaped folded segments 32 and 33 are inverted relative to the U-shaped channel protrusion 48, as illustrated in FIG. 2. Channel protrusions 48 serve as lateral support devices as they support folded segments 32 and 33 so that repeated insertions and retractions by an electrical plug through receiving socket 36 do not cause permanent deformation of folded segments 32 and 33. The insertion of folded segments 32 and 33 into channel protrusions 48, along an insertion axis, allow conductor member 16 to be made from a thinner material than would be possible without the support provided by channel protrusion 48, thereby reducing the cost of the assembly. Channel protrusions 48 also mechanically support folded segments 32 and 33, in a direction transverse to the insertion axis, which thereby enable receiving socket 36 to retain an acceptable amount of pressure on a plug blade inserted in receiving socket 36. Channel protrusions 48 eliminate the need for a spring or clip, which may otherwise be needed to provide additional strength to folded segments 32 and 33.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An electrical receptacle, comprising:

at least one conductor member having at least two folded segments oriented to define a receiving socket, said at least two folded segments including a first segment and a second segment each having a folded end and an other end, said folded end of said first segment and said folded end of said second segment spaced apart substantially the same distance as said other end of said first segment and said other end of said second segment; and a housing having at least one lateral support feature, said at least two folded segments insertable into a corresponding one of said at least one lateral support features along an insertion axis, said at least one lateral support feature supporting said at least two folded segments in a direction transverse to said insertion axis, said housing including at least one blade opening, said at least one blade opening being disposed proximate to at least one of said receiving sockets.

2. The receptacle of claim 1, wherein said at least one conductor member includes at least one electrical contact disposed on an end of said at least one conductor member.

3. The receptacle of claim 2, further comprising at least one electrical connector having a plurality of receiving openings, each of said at least one electrical connectors connected to said housing, each said at least one electrical contact configured to be inserted into a corresponding one of said plurality of receiving openings.

4. The receptacle of claim 1, wherein said housing includes at least one ground opening.

5. The receptacle of claim 1, wherein, said first segment and said second segment are generally parallel and are configured to not separate from each other by way of said at least one lateral support feature.

6. The receptacle of claim 1, wherein at least one of said lateral support features is a U-shaped protrusion.

7. The receptacle of claim 1, wherein at least one of said at least one lateral support comprises one of a protrusion and a recess in said housing.

8. A modular electrical receptacle, comprising:

at least one electrical connector including a plurality of electrical contact receiving openings;

at least one conductor member having at least two folded segments oriented to define a receiving socket, each said conductor member electrically interconnecting one of said receiving openings of one of said at least one electrical connector with a corresponding one of said receiving openings of an other of said at least one electrical connector, said at least two folded segments including a first folded segment and a second folded segment each having a folded end and an other end, said folded end of said first folded segment and said folded end of said second folded segment spaced apart substantially the same distance as said other end of said first folded segment and said other end of said second folded segment;

a housing having at least one lateral support, said at least two folded segments insertable into a corresponding one of said at least one lateral support along an insertion axis, said at least one lateral support supporting said at least two folded segments in a direction transverse to said insertion axis; and a faceplate being one of integral with and attached to said housing, said faceplate having at least two blade openings, each said blade opening being disposed proximate to a corresponding said receiving socket.

9. The receptacle of claim 8, wherein said at least one conductor member includes at least one electrical contact disposed on an end of each of said at least one conductor member.

10. The receptacle of claim 9, wherein each said at least one electrical contact is configured to be inserted into a corresponding one of said plurality of receiving openings.

11. The receptacle of claim 8, wherein at least one of said at least one lateral support is a U-shaped protrusion.

12. The receptacle of claim 1, wherein, said first folded segment and said second folded segment are generally parallel and are at least partially disposed within said U-shaped protrusion.

13. The receptacle of claim 8, wherein at least one of said at least one lateral support is one of a protrusion and a recess in said housing.

14. The receptacle of claim 13, wherein, said first folded segment and said second folded segment are generally parallel and are at least partially disposed within said lateral support.

15. A method of assembling a module electrical receptacle, comprising the steps of:

positioning a housing having at least one lateral support, to receive at least one conductor, said conductor having at least two folded segments defining a receiving socket, said at least two folded segments including a first segment and a second segment each having a folded end and an other end, said folded end of said first segment and said folded end of said second segment spaced apart substantially the same distance as said other end of said first segment and said other end of said second segment;

orienting each said conductor such that each said receiving socket is directed toward a corresponding one of a blade opening and a ground opening in said housing; and inserting said at least one conductor into said housing along an insertion axis such that at least one of said at least one lateral support transversely supports at least a portion of said at least one folded segment.

16. The method of claim 15, further comprising the steps of:

inserting an end of each of said at least one conductor into a corresponding receiving opening in an electrical connector; and connecting said electrical connector to an end of said housing.

17. The method of claim 16, further comprising the step of installing a back plate to said housing.

* * * * *

UNITED STATES PATENT AND TRADEMARK OFFICE

CERTIFICATE OF CORRECTION

PATENT NO. : 6,652,303 B2
DATED : November 25, 2003
INVENTOR(S) : Stockel et al.

It is certified that error appears in the above-identified patent and that said Letters Patent is hereby corrected as shown below:

Column 5,
Line 14, please delete “claim 1”, and substitute therefore -- claim 11 --.

Signed and Sealed this

Third Day of August, 2004

JON W. DUDAS
*Acting Director of the United States Patent and Trademark Office*